US006524080B2

(12) United States Patent
Chintamani et al.

(10) Patent No.: US 6,524,080 B2
(45) Date of Patent: Feb. 25, 2003

(54) HERMETICALLY SEALED COMPRESSORS

(75) Inventors: Chouthai Atul Chintamani, Karad (IN); Pasha Mohammed Afzal, Andhra Pradesh (IN)

(73) Assignee: R. K. Dewan & Co. (IN)

( * ) Notice: Subject to any disclaimer, the term of this patent is extended or adjusted under 35 U.S.C. 154(b) by 0 days.

(21) Appl. No.: 09/828,383

(22) Filed: Apr. 6, 2001

(65) Prior Publication Data

US 2001/0031208 A1 Oct. 18, 2001

(30) Foreign Application Priority Data

Apr. 11, 2000 (IN) ..... 338/MUM/2000
Apr. 11, 2000 (IN) ..... 340/MUM/2000
Apr. 11, 2000 (IN) ..... 336/MUM/2000

(51) Int. Cl.[7] ..... F04B 39/00; F04B 53/00

(52) U.S. Cl. ..... 417/312; 417/902; 181/212; 181/229

(58) Field of Search ..... 417/312, 415, 417/902; 181/229, 249, 403, 255, 212

(56) References Cited

U.S. PATENT DOCUMENTS 4,213,414 A * 7/1980 Sato et al. ..... 115/73
4,267,899 A * 5/1981 Wagner et al. ..... 181/272
4,313,715 A * 2/1982 Richardson, Jr. ..... 417/312
4,422,525 A * 12/1983 Seeger ..... 181/255
4,693,339 A * 9/1987 Beale et al. ..... 181/255
4,784,581 A * 11/1988 Fritchman ..... 417/312
5,341,654 A * 8/1994 Hewette et al. ..... 62/296
5,496,156 A * 3/1996 Harper et al.
5,804,777 A * 9/1998 Kim et al. ..... 181/229

* cited by examiner

*Primary Examiner*—Charles G. Freay
*Assistant Examiner*—Han L. Liu
(74) *Attorney, Agent, or Firm*—Bierman, Muserlian and Lucas

(57) ABSTRACT

A suction muffler for a hermetic sealed reciprocating compressor which comprises (i) a muffling chamber having a body of a synthetic polymeric material and (ii) a synthetic polymeric perforated tube passing through the muffling chamber carrying refrigerant fluid from the suction tube of the compressor to the suction port on the valve plate of a cylinder in which a piston reciprocates. The muffling tube may be made divergent along at least 10% of its length. The muffler is mounted directly in the cylinder head by means of a tongue and slot formation avoiding the need for a suction plenum between the suction muffler and the valve plate inlet.

9 Claims, 20 Drawing Sheets

HERMETICALLY SEALED COMPRESSORS

BACKGROUND OF THE INVENTION

This invention relates to hermetically sealed compressors.

In particular, this invention relates to an improved plastic suction muffler configuration for hermetically sealed compressors of the reciprocating type.

Hermetically sealed compressors also known as hermetic compressors are used to compress low-pressure vapor from an evaporator and deliver high pressure and high temperature vapor to a condenser.

Such hermetically sealed compressors of the reciprocating-type, usually consist of a motor-compressor unit mounted within a hermetically sealed shell. Such compressors have an electric motor-driven piston reciprocating in a cylinder at relative high speeds of 3000 to 4000 r.p.m., which draws in and compresses a refrigerant fluid.

The hermetically sealed compressor generally comprises a lower and upper shell, inside which three or more resilient members hold the pump assembly (coil springs). The whole assembly body is supported by legs, which are attached to the lower shell. The pump assembly consists of a motor component stator and rotor and a refrigerant fluid compressor mechanism. The rotor is fitted directly on the crankshaft. The crankshaft is housed in the main bearing provided in the crankcase. The stator is mounted on the crankcase through fasteners. The power required for rotation of the crankshaft is given by the motor.

The reciprocating movement of the piston causes intermittent flow of refrigerant fluid through valves. This intermittent flow of fluid through the system causes undesirable levels of noise. The reciprocating mechanism used to compress the refrigerant also generates a lot of high frequency series of pulses which if allowed to act directly on the refrigerant fluid cavity leads to vibration of the compressor and/or generates more noise in the audible frequency range. Usually a pulse attenuator /silencer or acoustic dampening system or a muffler becomes necessary on both, the suction and the discharge side of the pumping mechanism to take care of this effect.

In the hermetically sealed refrigeration compressor, refrigerant fluid enters through the suction tube and travels into the shell, which surrounds the pump assembly. The refrigerant fluid is further picked up by the suction pick up tube and led into the crankcase, which then goes into the suction plenum in the cylinder head through suction mufflers, which are in built in the crank case. Inside, the motor and pump assembly are cooled by refrigerant available inside the shell cavity. In this process the refrigerant fluid picks-up heat from these (motor and pump assembly) hotter components before it reaches in to the crankcase by heat convection. It is well known from basics of thermodynamics that refrigerant fluid super heating will result in reduced compressor performance as density of refrigerant fluid reduces with increased temperature which means less mass flow rate in to the cylinder bore.

Generally the suction and discharge mufflers are in built in the crankcase, which is of a highly conductive material, or are fitted as separate metallic components, which are good thermal conductors.

The refrigerant fluid passes through these conventional fluid passages either separate or in built in the crankcase and in so doing picks up heat from the surrounding hotter bodies before it reaches to bore. This is undesirable. There is also a pressure drop of about 1 psi as the refrigerant fluid passes through the muffler. This pressure drop results in decrease in the velocity of the refrigerant fluid and its consequent expansion.

This invention particularly relates to suction mufflers, typically of synthetic polymeric material having thermal insulating characteristics.

Known plastic suction mufflers of the type have a hermetic shell muffler body having an internal chamber and are fitted with a fluid inlet opening and a fluid outlet opening. The fluid inlet fluid outlet opening is in tight communication with the suction valve of the compressor, typically through a suction plenum. In addition to attenuating noise levels the muffler chamber together with the suction plenum also provides an immediate reservoir of refrigerant fluid for the suction stroke of the piston.

In the process of dampening pulses and attenuating noise levels, the prior art mufflers cause a pressure drop because of the flow restrictive property of the muffler chamber into which the refrigerant fluid is led. This pressure drop causes a reduction in the compressor efficiency. Volumetric efficiency of the compressor depends upon compression ratio and clearance volume. Higher suction pressure drop in the muffler will increase the compression ratio and consequently reduce volumetric efficiency of the compressor. Which means that the amount of compressed refrigerant fluid transmitted through the discharge port will be reduced for the same displacement of the piston.

Known prior art suction mufflers are described in U.S. Pat. Nos: 4,370,104; 4,415, 060; 4,582,468; 4,759,693; 4,960,3,68; 5,201,640 and the like.

OBJECTS OF THE INVENTION

It is a general object of the invention to provide a suction muffler for reciprocating hermetically sealed compressors which provide attenuation of noise created by the flow and pulsation of the refrigerant fluid and at the same time minimizes the pressure drop across the muffler and thereby reduces the loss in compression or thermal efficiency resulting from the provision of the muffler.

It is an object of the present invention to provide a suction muffler which eliminates the need of a suction plenum in a hermetically sealed compressor.

It is an object of the present invention to provide a new muffler which reduces the effect of superheating of the refrigerant fluid to a great extent.

Another object of the suction muffler is that it is designed such that it results in less pressure drop across it and good attenuation of the suction pulse for a wide band of audible frequencies typically from 0.5 KHz to 3 KHz.

Another object of the invention is to propose a suction muffler which can be directly fitted on the cylinder head by a novel mounting means, eliminating the requirement of a suction plenum between the muffler and the suction valve of the compressor and also eliminating additional clamping means for fitting the suction muffler to the cylinder head.

A particular object of the invention is to provide a suction muffler which is able to suppress low frequency noise [50 to 3000 Hz] generated by refrigerant fluid flow and pulsation.

A still particular object of the invention is to provide a suction muffler in which the refrigerant fluid is led into the muffler with minimum turbulence and reduced pressure drop and traverses the muffler chamber without experiencing any restriction in flow or a sudden change in direction.

SUMMARY OF THE INVENTION

According to this invention there is provided a suction muffler for a hermetically sealed compressor of the reciprocating piston type, which comprises a muffling chamber having a body of a synthetic polymeric material and a synthetic polymeric perforated tube passing through the muffling chamber carrying refrigerant fluid from the suction tube of a compressor to the suction port on the valve plate of the cylinder in which a piston reciprocates.

In accordance with another aspect of the invention the said perforated tube is made to diverge at least along part of its length within the muffling chamber.

Plastic mufflers pose their own problems of fitting. A main problem is to fit these plastic mufflers onto the cylinder head.

Such a fitting is required to be stable at various temperatures and withstand vibrations during normal running of the compressor and during transportation. Various types of clamps and bolts, have been resorted to provide for such fittings including 'C' clamps and 'O' clamps however these fittings are far from satisfactory.

In the present invention a new method of mounting the plastic suction muffler is developed which avoids additional clamping and bolts for its fitment.

According to still another aspect of this invention therefore, there is provided a method of mounting a muffler directly on the cylinder comprising the steps of:

{i} forming a projection on the muffler tube in the proximity of its outlet end;

{ii} forming a slot on the cylinder head complementary to the projection formed on the muffler tube; and {iii} mounting the muffler in the cylinder head by press fitting the projection on the muffler tube into the slot in the cylinder head.

Therefore there is provided a hermetically sealed compressor which comprises a motor compressor assembly mounted in a shell which includes a cylinder head and a muffler in which the muffler is fitted to the cylinder head by means of a male projection formed on the muffler tube near its outlet end and a complementary slot formation provided in the cylinder head and clamped over by the pressure of the valve plate.

According to this invention there is therefore provided a hermetically sealed compressor which comprises a motor compressor assembly mounted in a shell which includes a cylinder head and a muffler in which the muffler is fitted to the cylinder head by means of a male projection formed on the muffler tube and a complementary slot formation provided in the cylinder head and clamped over by the pressure of the valve plate.

This invention therefore teaches the concept of making one or more projections on the muffler tube (irrespective of its shape and geometric dimensions) near the outlet of the muffler tube which will directly press fit in to a slot made in the cylinder head which will restrict the muffler movement in the axial or transverse direction as this projection is press fitted in to the cylinder head slot avoiding any other clamping arrangement except the conventional pressure valve plate that fits over the cylinder head.

In accordance with another embodiment of the invention, the projection made on the muffler tube may be further secured by using any adhesive agent, or by any additional clamping arrangement in the cylinder head.

The invention will now be described with reference to the accompanying drawings.

DETAILED DESCRIPTION OF THE DRAWINGS

The invention will now be described in detail with reference to the accompanying drawings.

Figure 1:
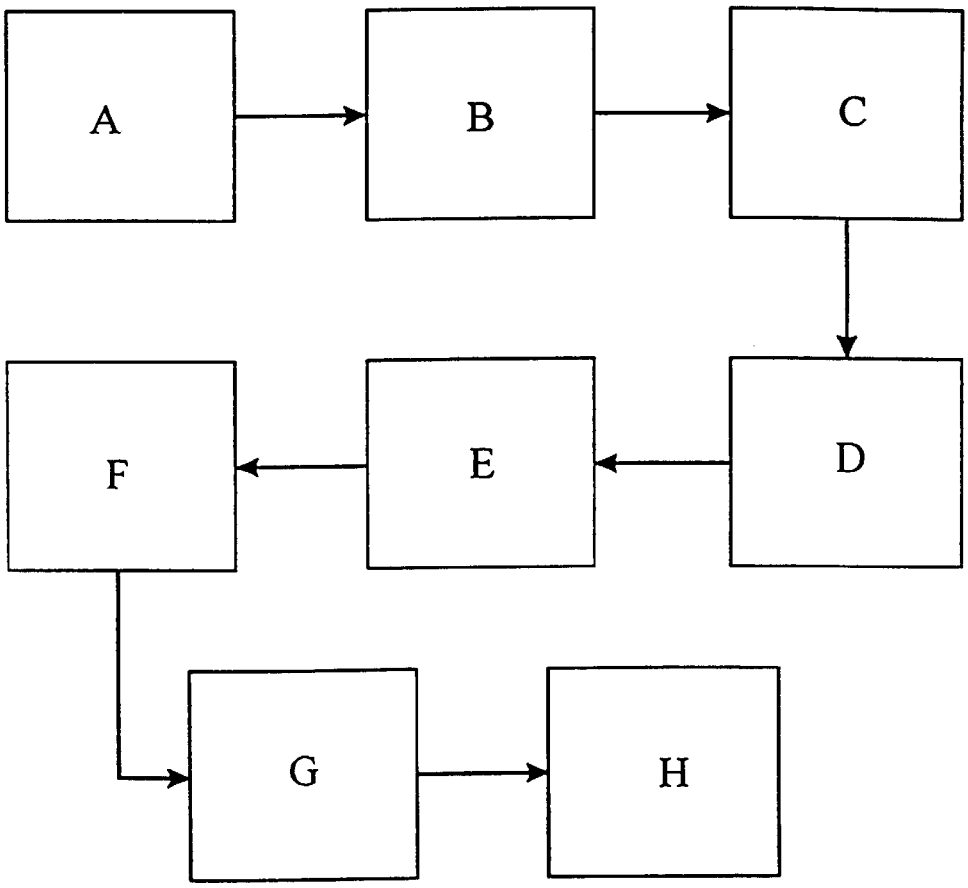
FIG. 1 is a block diagram showing the operation of a conventional hermetically sealed compressor.

A typical hermetically sealed compressor working in the prior art, is explained in the block diagram as seen FIG. 1 of the accompanying drawings. In a hermetically sealed compressor refrigerant fluid enters the shell cavity through a suction tube [A]. This refrigerant fluid is sucked in the suction muffler [B] due to suction stroke of the piston. The refrigerant fluid flows to the cylinder bore via the suction plenum[C] in the cylinder head through a passage in the crankcase or connecting tubes between the suction muffler and suction port in the valve plate [D]. This low-pressure refrigerant fluid is compressed to high pressure and delivered to the discharge muffler [G] via the discharge port [E] in the valve plate to the cylinder head plenum [F]. In the discharge plenum refrigerant fluid is attenuated [G] and delivered to the condenser of the appliance through a discharge tube [H] connected to the discharge muffler by a discharge shock loop.

Figure 2:
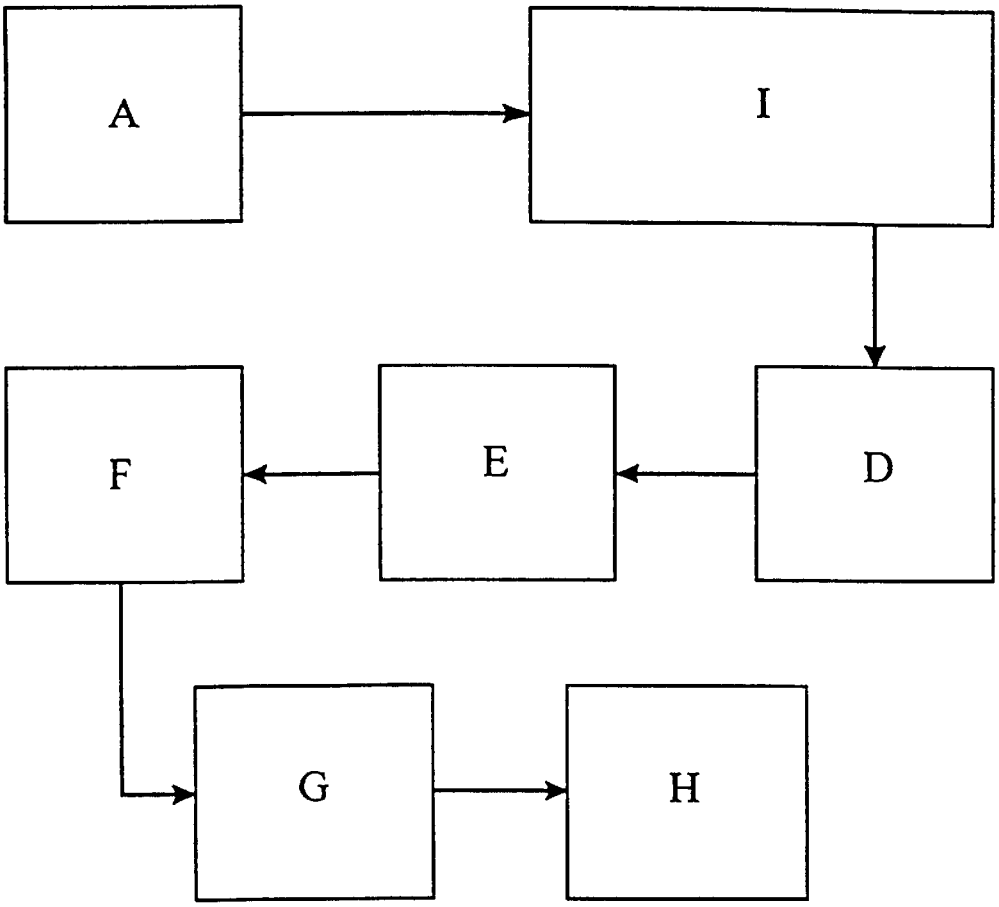
FIG. 2 is a block diagram showing the operation of the hermetically sealed compressor in accordance with this invention.

FIG. 2 is a block diagram of the operation of the hermetically sealed compressor in accordance with the present invention, in which the components [B] and [C] are replaced by the suction muffler [I] of the present invention. Thus, the configuration and mounting arrangement, taught in accordance with this invention eliminates a suction plenum [C] of the prior art.

Figure 3:
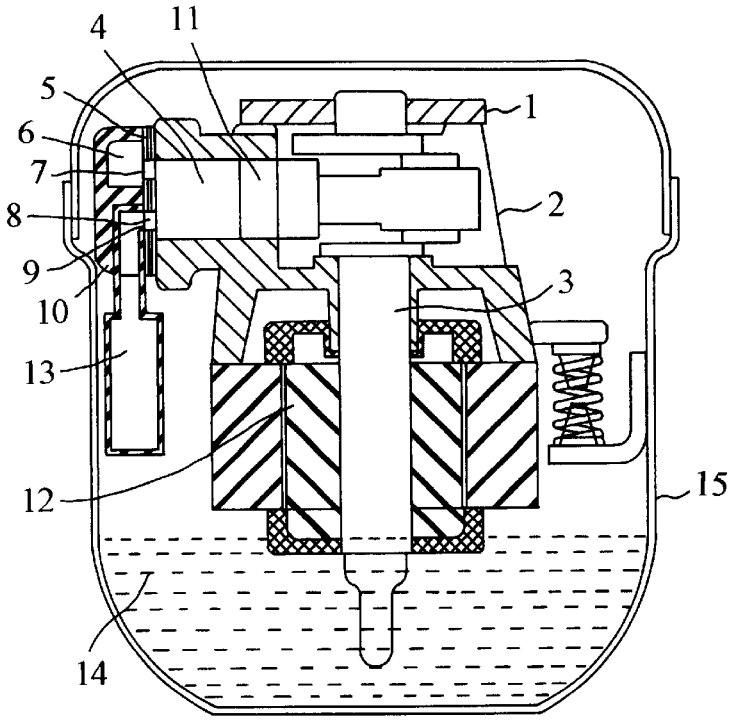
FIGS. 3 and 3*a* are schematic sectional views showing the muffler in accordance with this invention in its fitted configuration.
Figure 3A:
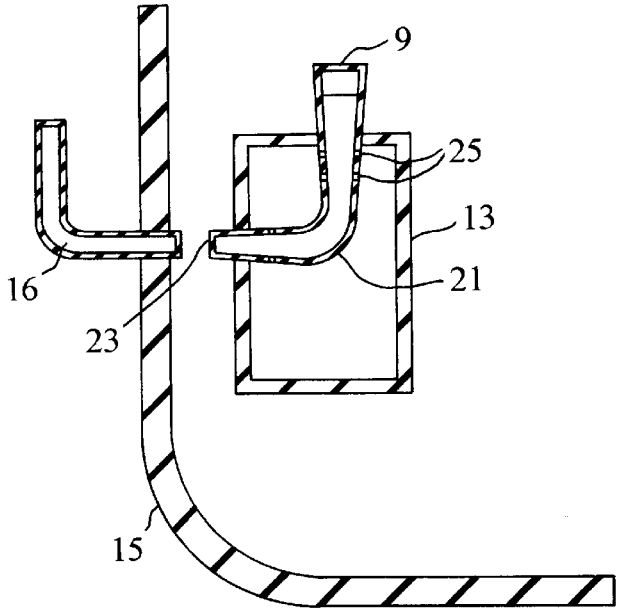

FIG. 3 is a schematic sectional view showing the muffler [13] in accordance with this invention in its fitted configuration;

In FIG. 3 the muffler 13 is seen fitted in the cylinder head 10 and the muffler outlet 9 is in direct communication with the suction port 8 of the cylinder bore 4 in which the piston 11 reciprocates. In FIG. 3 the discharge port 7 and the discharge plenum 6 formed in the cylinder head 10 are also shown. The suction port 8 and the discharge port 7 are formed in a valve plate 5. The connecting rod 1, the crankshaft 3 moving in crankcase 2, the rotor 12 and the lubricating oil sump 14 are also seen in FIG. 3. The compressor is housed in a shell 15. The suction tube; 16 is seen in FIG. 3*a*. The suction tube 16 outlet into the shell 15 is aligned with the inlet 23 of muffler tube 21. Refrigerant fluid enters the muffler tube inlet 23 partly from the suction tube 16 directly and partly from the refrigerant fluid entrapped within the shell 15.

Figure 4:
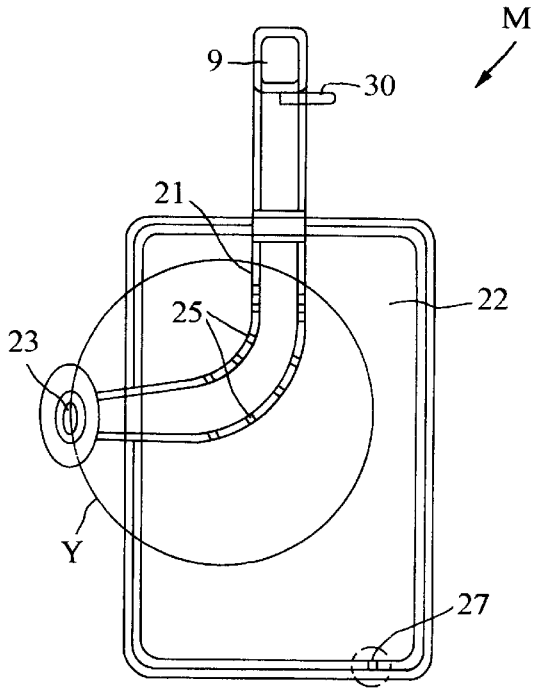
FIG. 4 is a schematic sectional view of the muffler in accordance with this invention.
Figure 5:
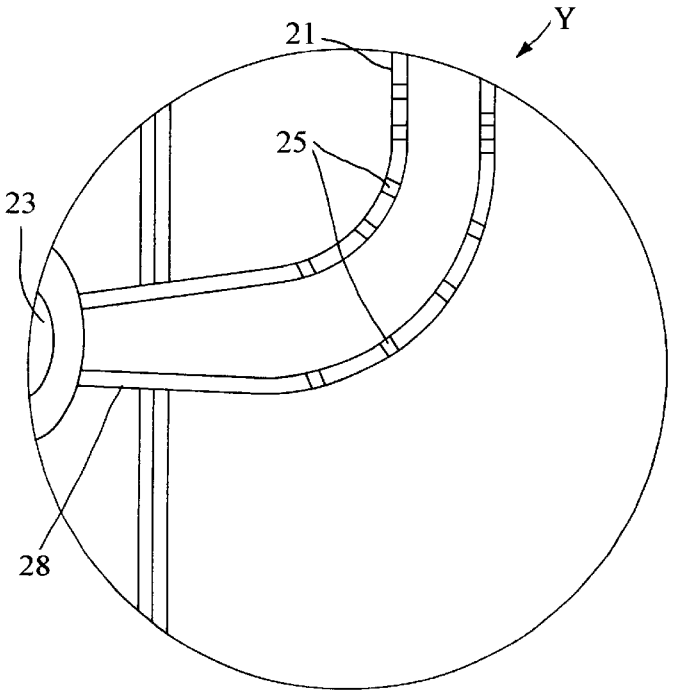
FIG. 5 shows the enlarged details of the portion marked Y in FIG. 4 showing the divergent portion 28 in the muffler tube.

FIG. 4 is a schematic sectional view of the muffler in accordance with this invention and FIG. 5 shows the enlarged details of the portion marked Y of the muffler tube 21 showing the divergent portion.

Referring to FIG. 4 of the drawings, The suction muffler generally indicated by the reference numeral M consists of a perforated tube 21, whose diameter, shape & number, of perforations are designed to attenuate frequencies from 500 to 3000 Hz. The muffler tube 21 is formed within muffling chamber 22 of suitable shape & size. The refrigerant fluid is picked,up partially from within the shell 15 and partially directly from suction tube 16 of compressor and is sucked through inlet 23 of the tube 21 of the suction muffler M. This tube 21 is extended up to a muffler tube outlet 9 which is in direct communication with the suction port 8 [as seen in FIG. 3] and refrigerant fluid is delivered to suction port 8 of valve plate 5 from outlet 9. The muffler tube 21 is provided with perforations 25 (of suitable shape, size and numbers to attenuate frequency band 0.5 to 3 KHz). These perforations 25 open in the muffling chamber :(23). An oil drain hole (27), of any diameter up to 0.125" is provided at the bottom of the suction muffler M to drain oil accumulated in the muffler chamber 23 and return it to the oil sump 14 seen in FIG. 3. This extraction of oil also results in improving the efficiency of the compressor.

In accordance with a preferred embodiment of the invention the perforated tube 21 and the muffling chamber 23 are integrally molded as two separate halves and are joined together by bonding or ultrasonic welding.

Polypropylene is a preferred material for the muffler in accordance with this invention.

Typically, the diameter of the perforated tube 21 may vary from 0.01 inch to 1 inch. Typically, the number of perforations vary from 4 to 120. Preferably, the perforations are 4 to 25 in number and optimally 12 in number. Preferably, the diameter of the perforations vary from 0.01 to 0.25 inch and the perforations may be in circular, semicircular or oval shape, with an optimal tube diameter TD of 0.36 inch and a perforation diameter PD of 0.0625 inch. The optimal TD/PD ratio is 6 with an acceptable range of 2 to 10.

FIG. 5 shows the enlarged details of the portion marked Y of the muffler tube 21 showing the divergent portion 28. In a preferred embodiment of the invention the tube 21 is made to diverge at least 10 percent of its length starting from its inlet 23 although it can theoretically diverge throughout its length from the inlet to the outlet. The angle of divergence may vary from one degree to twenty five degrees. An optimum divergence is 3 to 10 degrees. The pressure drop across the muffler is reduced by 20 to 50 per cent.

Figure 6:
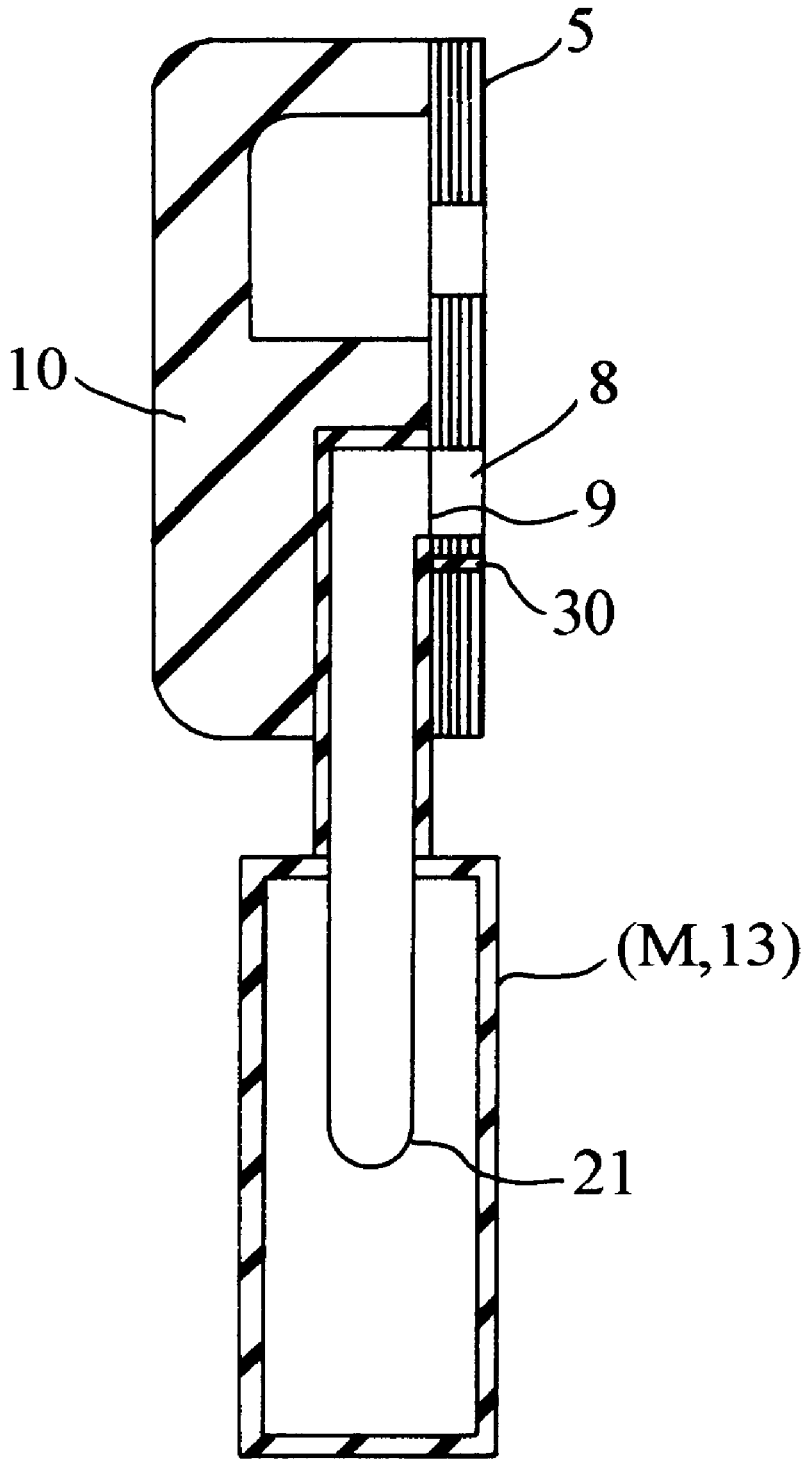
FIG. 6 shows an enlarged sectional view of the muffler in accordance with this invention in its mounted configuration.
Figure 7:
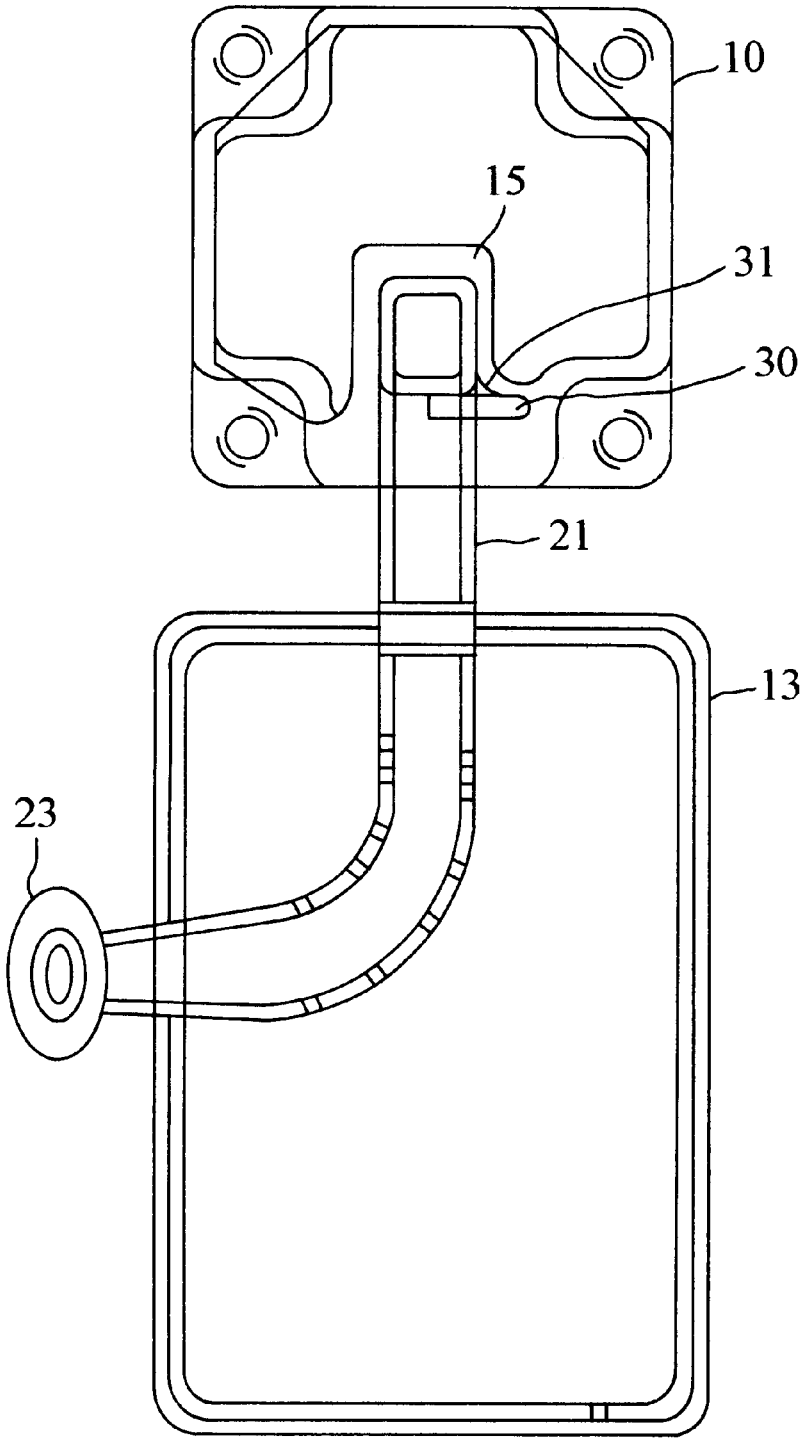
FIG. 7 shows a partial front opened sectional view of the mounted configuration of the muffler as seen in FIG. 6.
Figure 8:
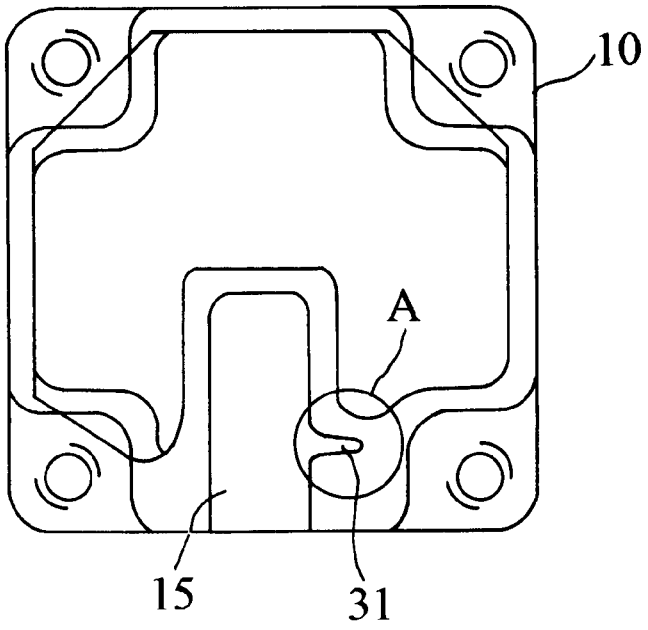
FIGS. 8 and 8*a* show the modifications made in the cylinder head to accommodate the muffler in accordance with this invention.
Figure 8A:
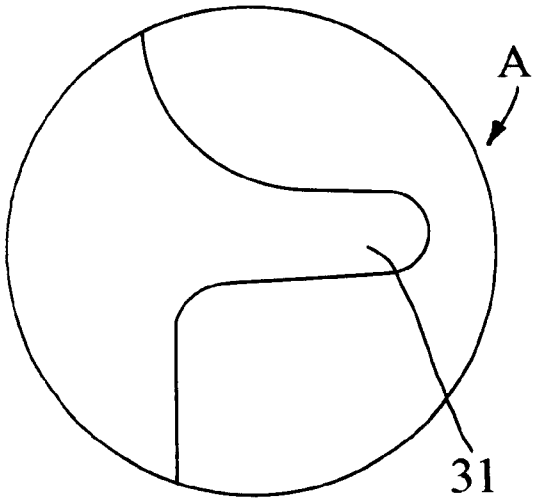

FIG. 6 shows an enlarged sectional view of the muffler in accordance with this invention in its mounted configuration ,and FIG. 7 shows a partial front opened sectional view of the mounted configuration of the muffler as seen in FIG. 6. FIGS. 8 and 8*a* show the modifications made in the cylinder head to accommodate the muffler [M, 13] in accordance with this invention.

Referring to FIGS. 6 to 8*a* of the drawings The muffler tube 21 is provided with a projection tongue 30 near the muffler tube outlet 9 which is in direct communication with the suction port 8 [as seen in FIG. 3] and refrigerant fluid is delivered to suction port 8 of valve plate 5 from outlet 9.

FIGS. 8 and 8*a* show details of the cylinder head 10. A slot 31 is provide in the cylinder head 10 which cooperates with the projection tongue 30 provided near the muffler tube outlet 9. The details of the slot are seen in FIG. 8*a*.

As seen in FIGS. 7 and 8 for fitting the muffler to the cylinder head the projection tongue 30 on the muffler tube is press fitted into the slot 31 this engages the suction port 8 outlet with the muffler tube outlet 9 and no additional fitments are required although resin bonding may be additionally resorted to. Enlarged view of the portion marked A in FIG. 8 is seen in FIG. 8*a*. As seen in the FIGS. 8 and 8A a cylinder head pressure valve plate 5 covers the complementary projection and slot formation and this valve plate 5 acts as a clamping fitment for the muffler tube outlet 9 and the suction port 8 permitting traverse of refrigerant fluid therethrough and secures the complementary projection and slot fitment.

The complementary formations 30 and 31 therefore help to locate the muffler and the cylinder head and provide for its fitting without the need for any additional clamping or fitment arrangements except cylinder head pressure on the valve plate.

Figure 9:
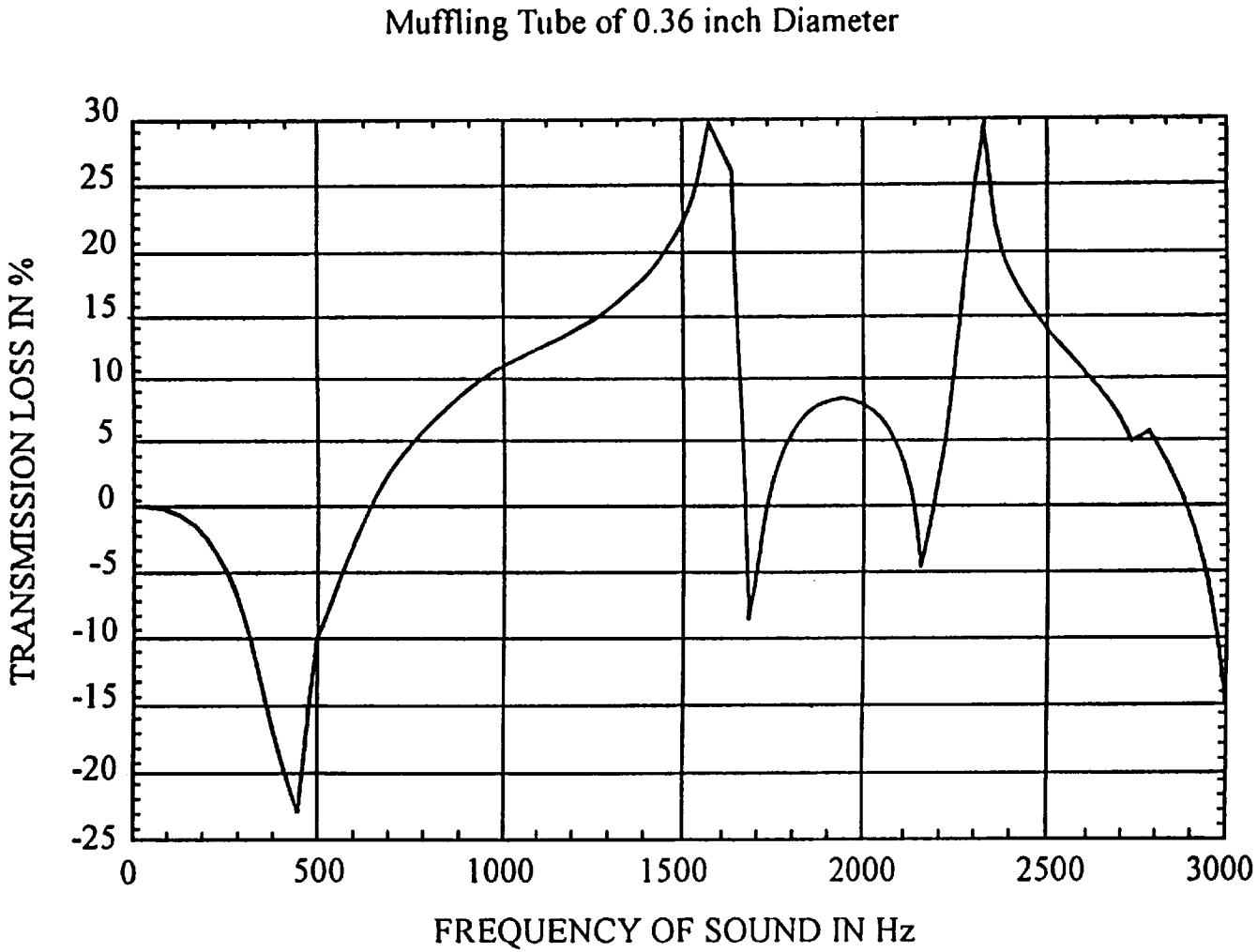
FIG. 9 is a graph showing the attenuation features of the muffler of FIG. 4 in use.

FIG. 9 shows the attenuation of noise using a suction muffler having 12 perforations and a TD/PD of 6, the analysis being done using a sysnoise package. The X axis represent the frequencies of sound up to 3000 Hz and the Y-axis represent the transmission loss TL as a percentage of the noise generated. A greater loss in transmission represents a better attenuation of sound. The graph shows that there is good attenuation of noise in the 500 Hz to 2500 Hz frequency band which is the audible range and therefore results in a compressor with a relatively reduced noise operation.

Experiments were conducted to optimize the number of perforation, the size of the perforated area the shape of the perforations and the ratio of perforated area to main tube area. Experiments were also conducted to optimize the divergence of the muffler tube. Some of the relevant results of these experiments are reflected graphically in FIGS. 10 to 20.

Figure 10:
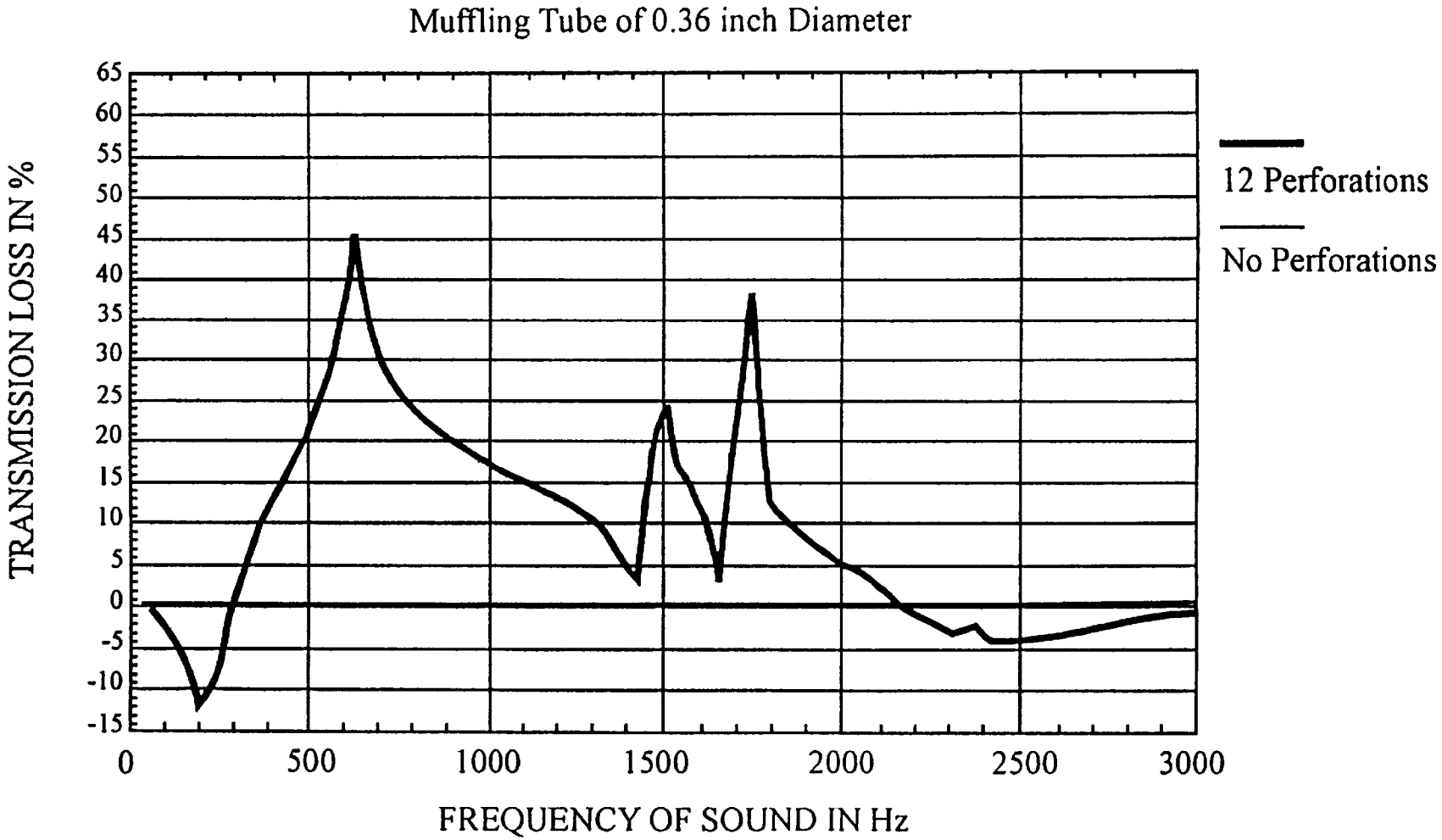
FIG. 10 is a graph showing the comparison of the noise level of a perforated tube with 12 perforations as compared to a tube, with no perforations.

FIG. 10 is a graph showing the comparison of the noise level of a perforated tube with 12 perforations as compared to a tube with no perforations.

Figure 11:
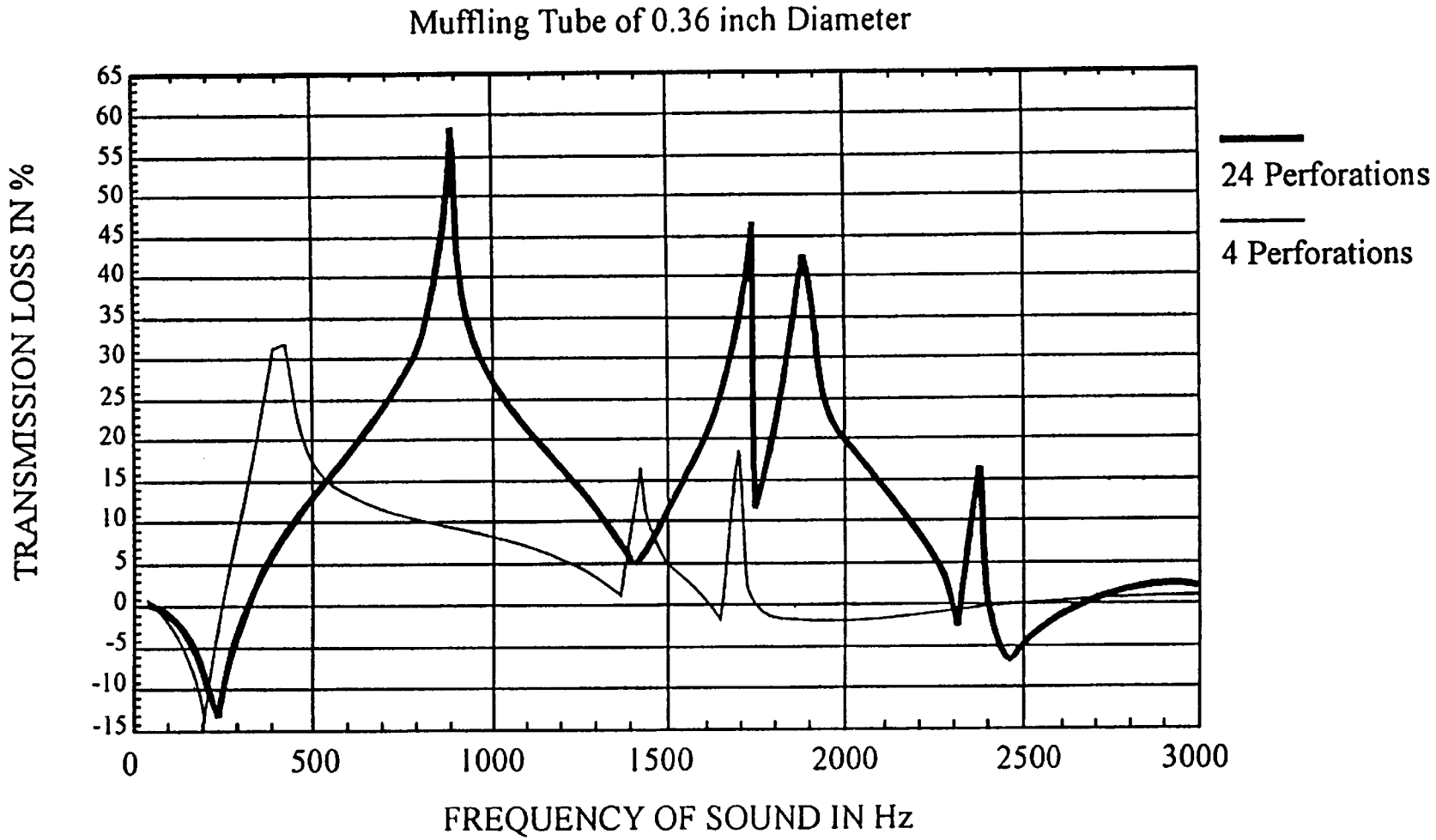
FIG. 11 is a graph showing the difference in attenuation of sound with muffler tubes having 4 and 24 perforations.

FIG. 11 is a graph showing the difference in attenuation of sound with 4 and 24 perforations .

Figure 12:
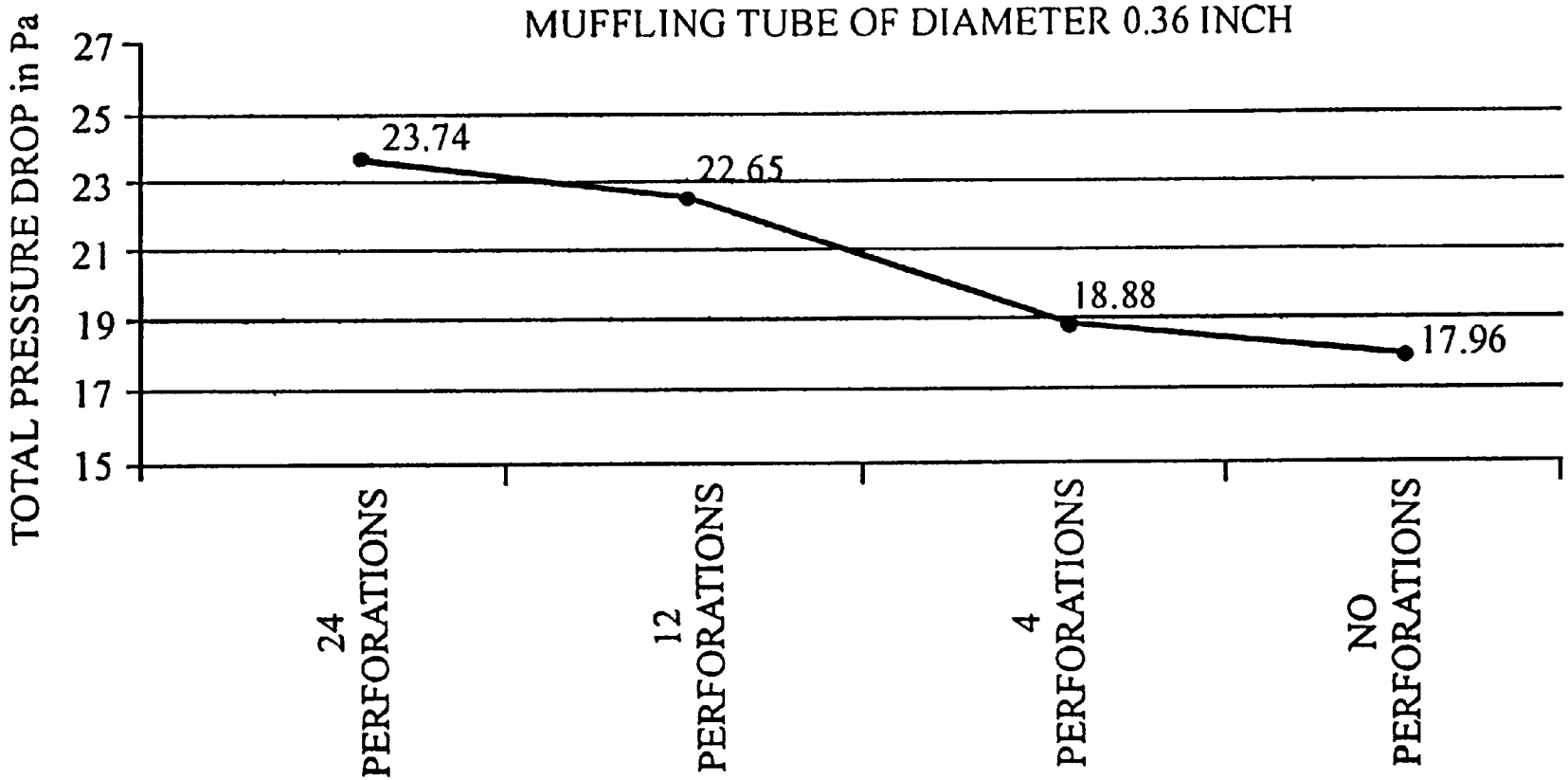
FIG. 12 is a graphical representation of the pressure drop resulting from different perforations in the muffler tube of the invention.

FIG. 12 is a graphical representation of the pressure drop resulting from different perforation levels in the muffler tube of the invention.

Figure 13:
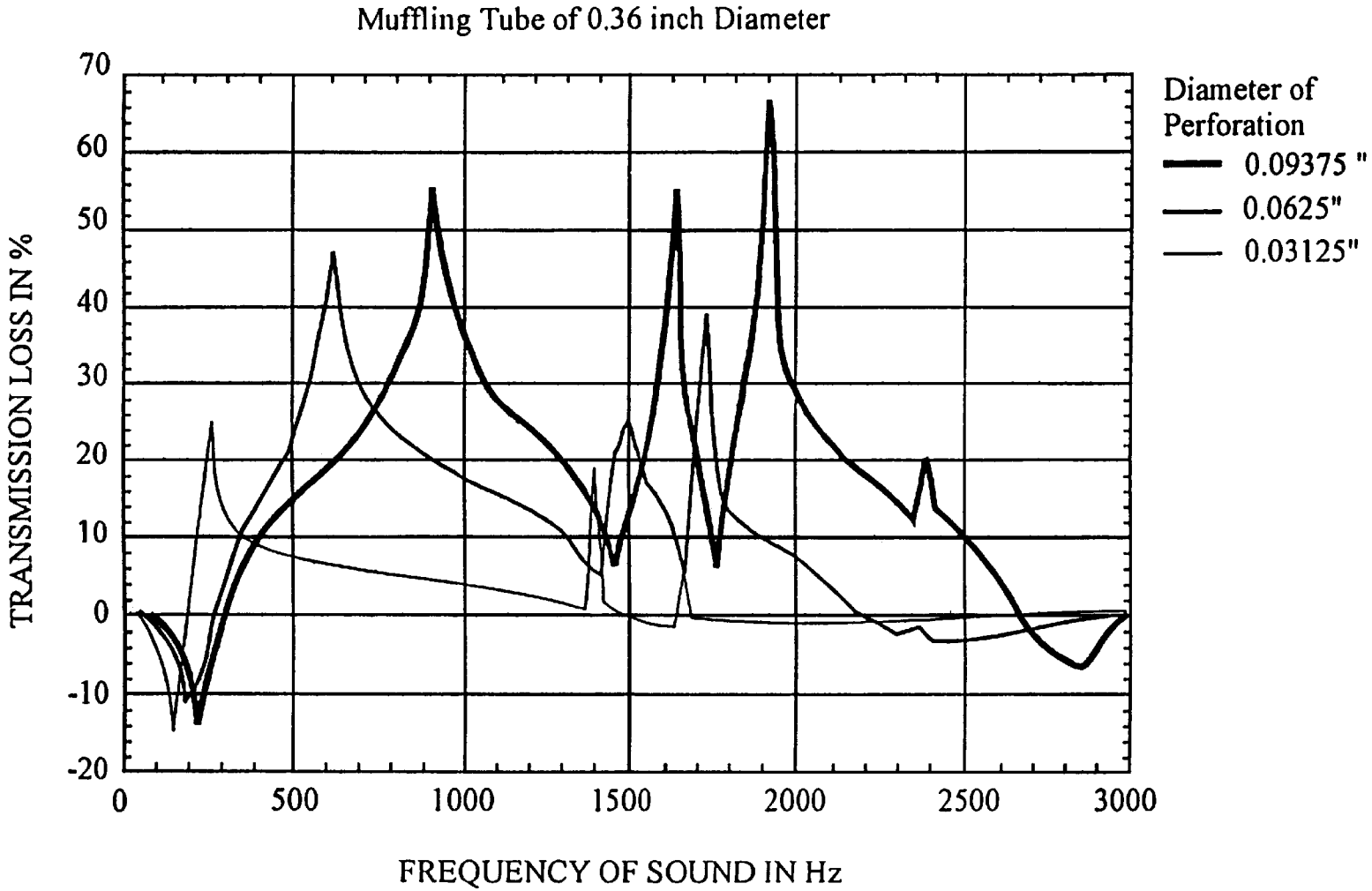
FIG. 13 is a graphical representation of the relationship of the perforated area of the tube to the attenuated sound achieved by varying the diameter of the perforations.

FIG. 13 is a graphical representation of the relationship of the perforated area of the tube to the attenuated sound. The perforated tube area is varied by varying the diameter of the perforations.

Figure 14:
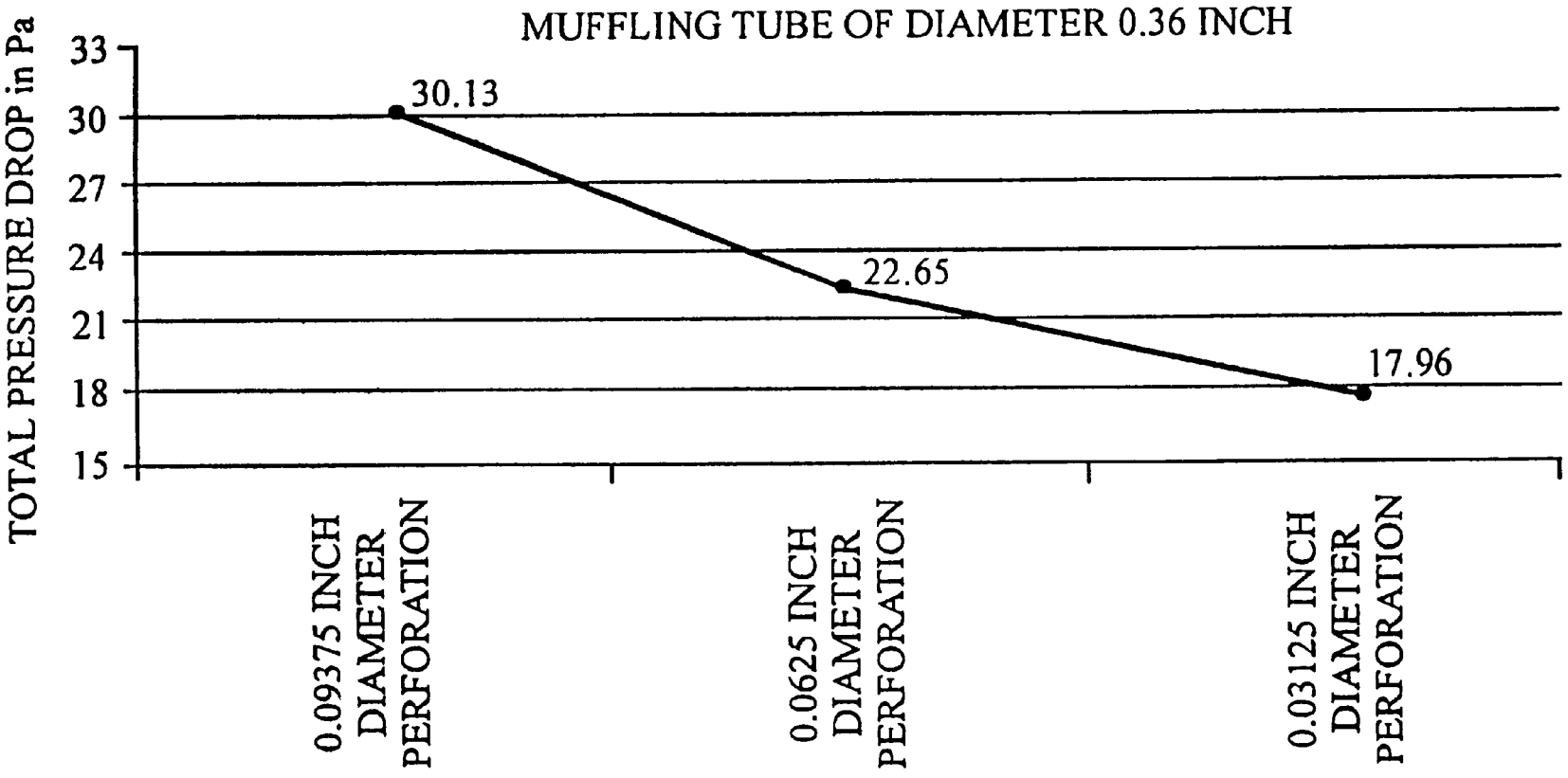
FIG. 14 is a graphical representation of the relationship of the perforated area of the tube to the pressure drop.

FIG. 14 is a graphical representation of the relationship of the perforated area of the tube to the pressure drop.

Figure 15:
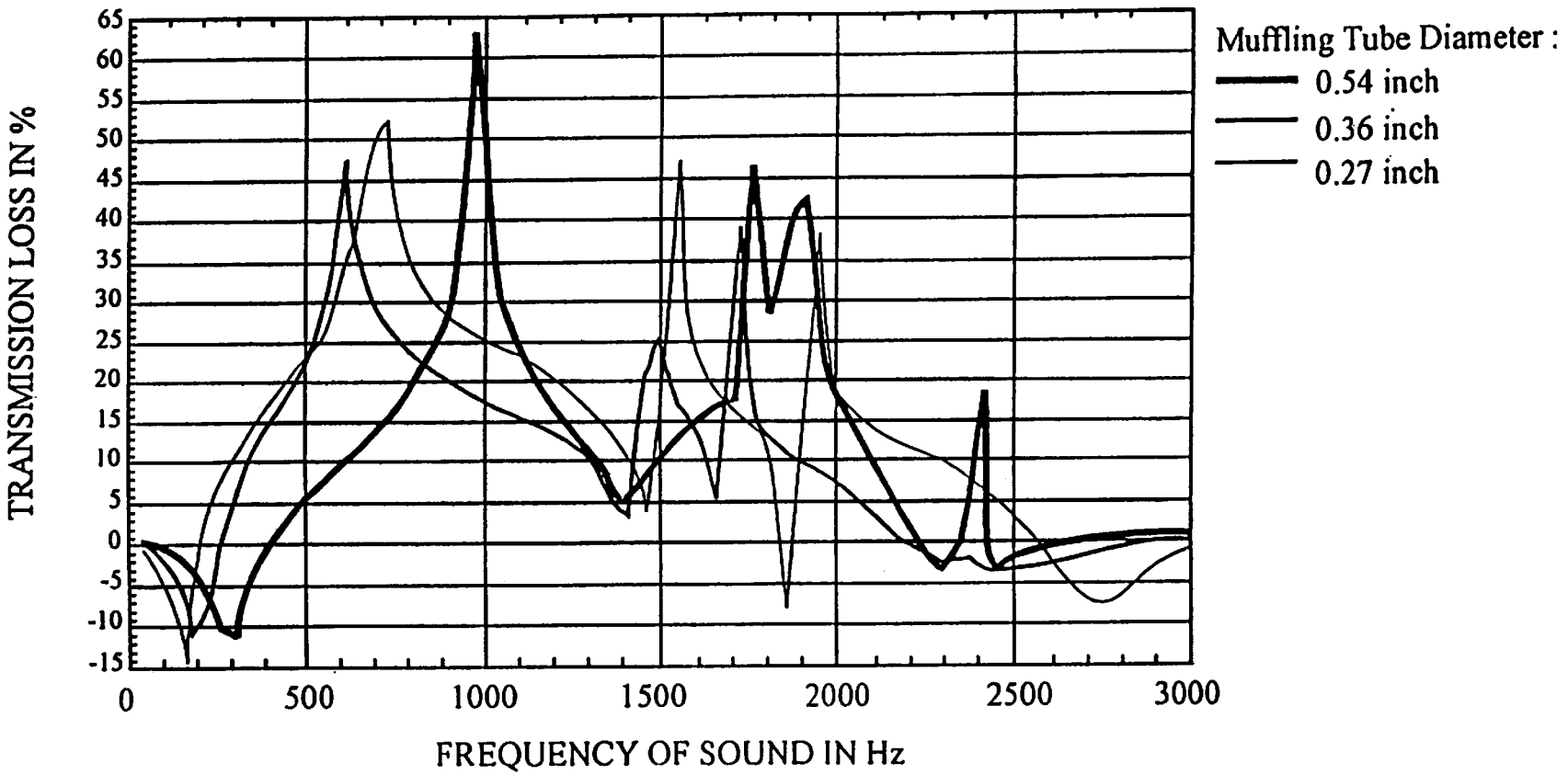
FIG. 15 is a graphical representation of the change in muffling tube area to the attenuation of sound.

FIG. 15 is a graphical representation of the change in muffling tube area to the attenuation of sound.

Figure 16:
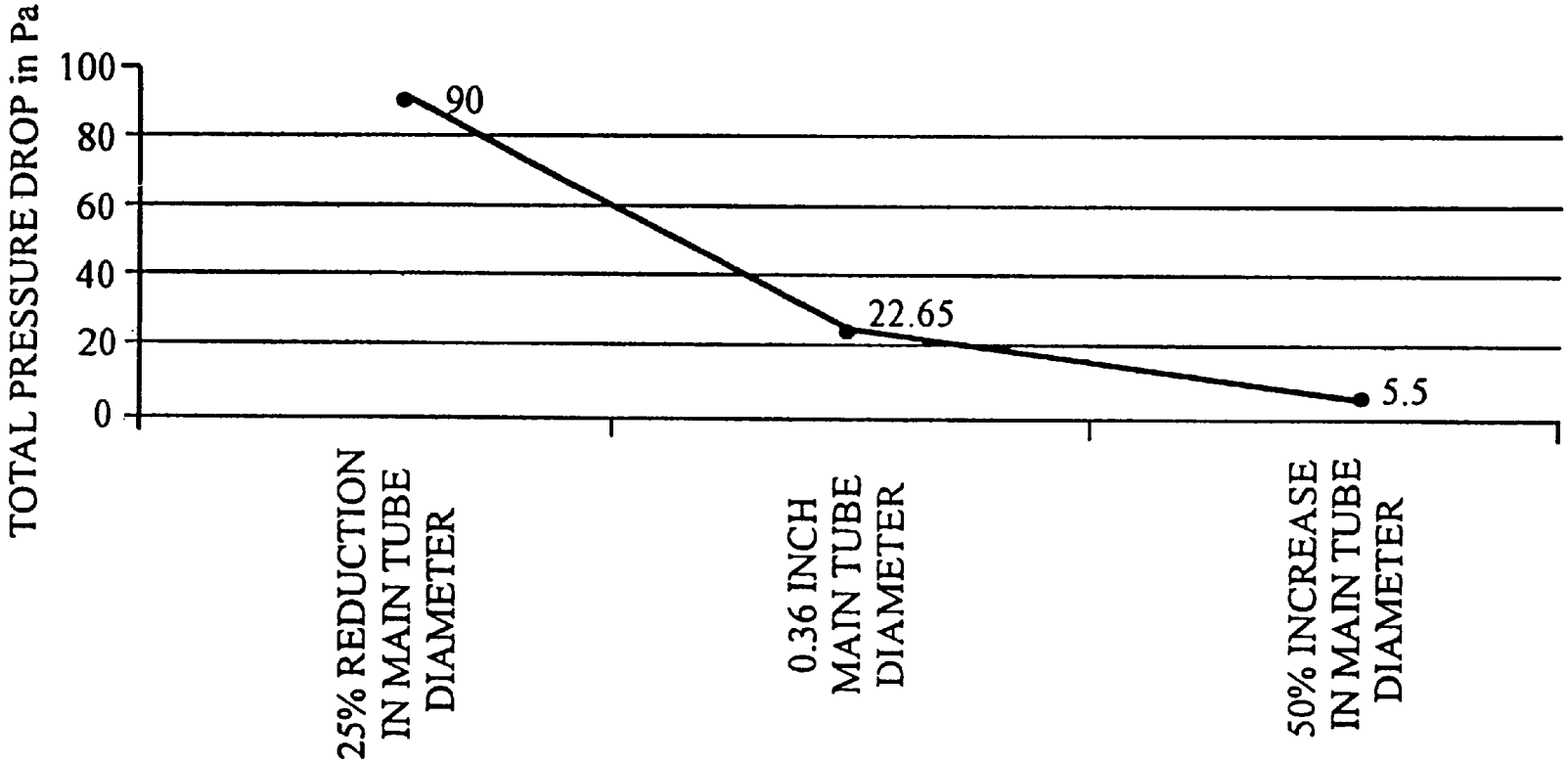
FIG. 16 is a graphical representation of the relationship of the change in main tube area to the pressure drop.

FIG. 16 is a graphical representation of the relationship of the change in main tube area to the pressure drop.

Figure 17:
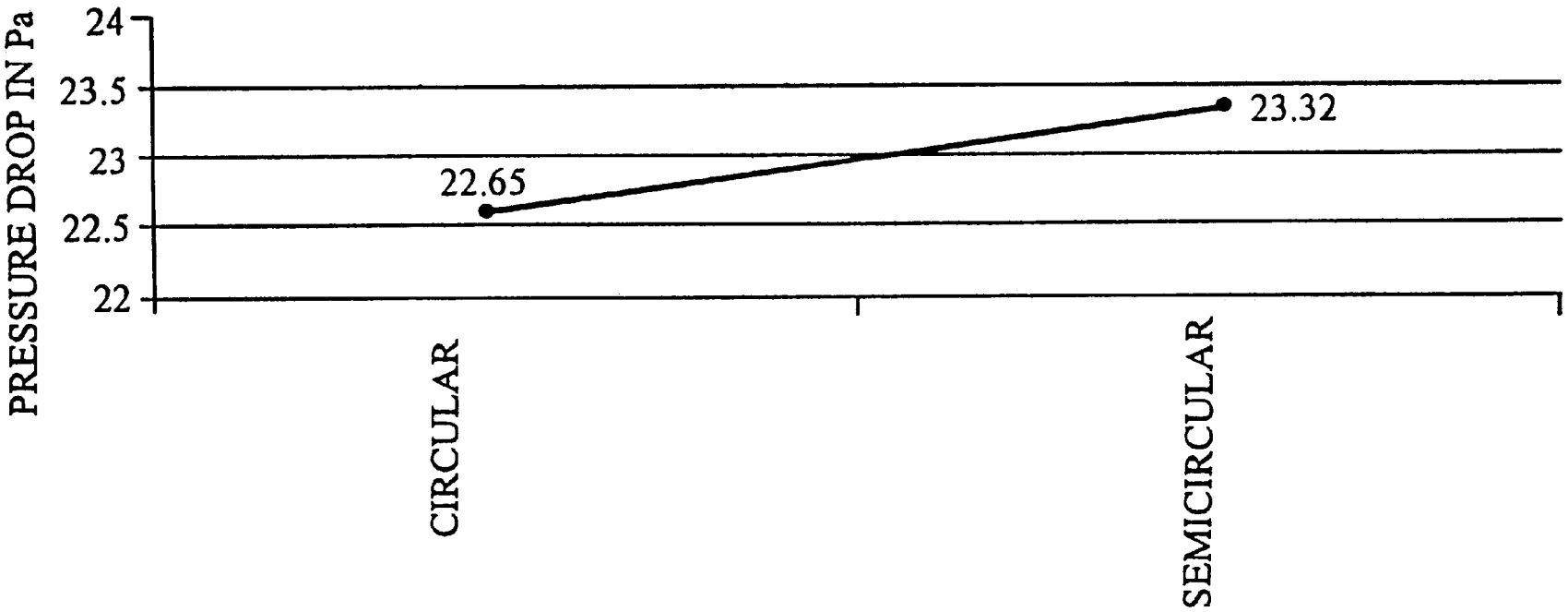
FIG. 17 is a graphical representation showing the variation in pressure drop in relation to the shape and configuration of the perforation.

FIG. 17 is a graphical representation showing the variation in pressure drop in relation to the shape and configuration of the perforation.

Figure 18:
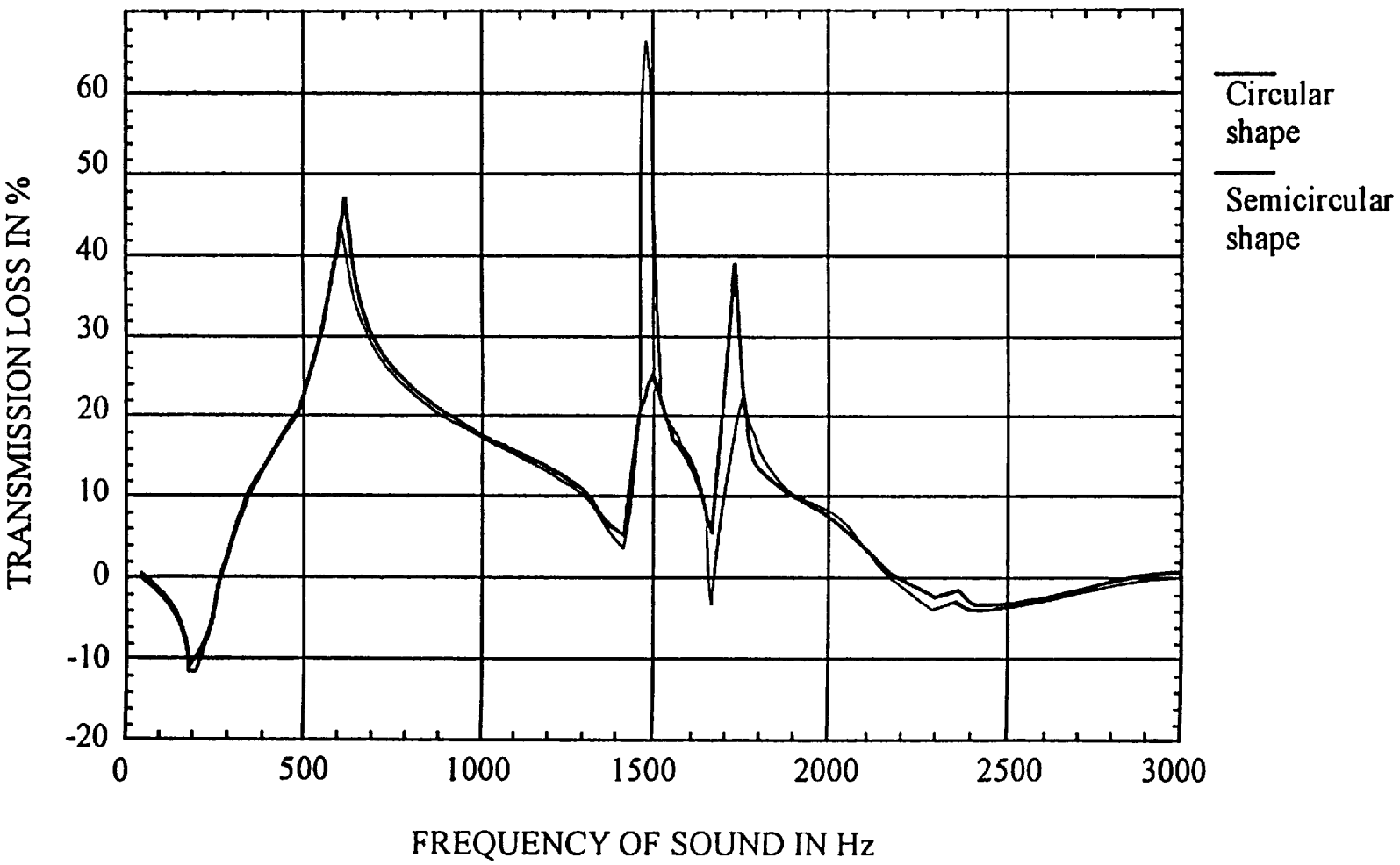
FIG. 18 is a graphical representation showing the variation in sound attenuation in relation to the shape and configuration of the perforation.

FIG. 18 is a graphical representation showing the variation in sound attenuation in relation to the shape and configuration of the perforation.

Figure 19:
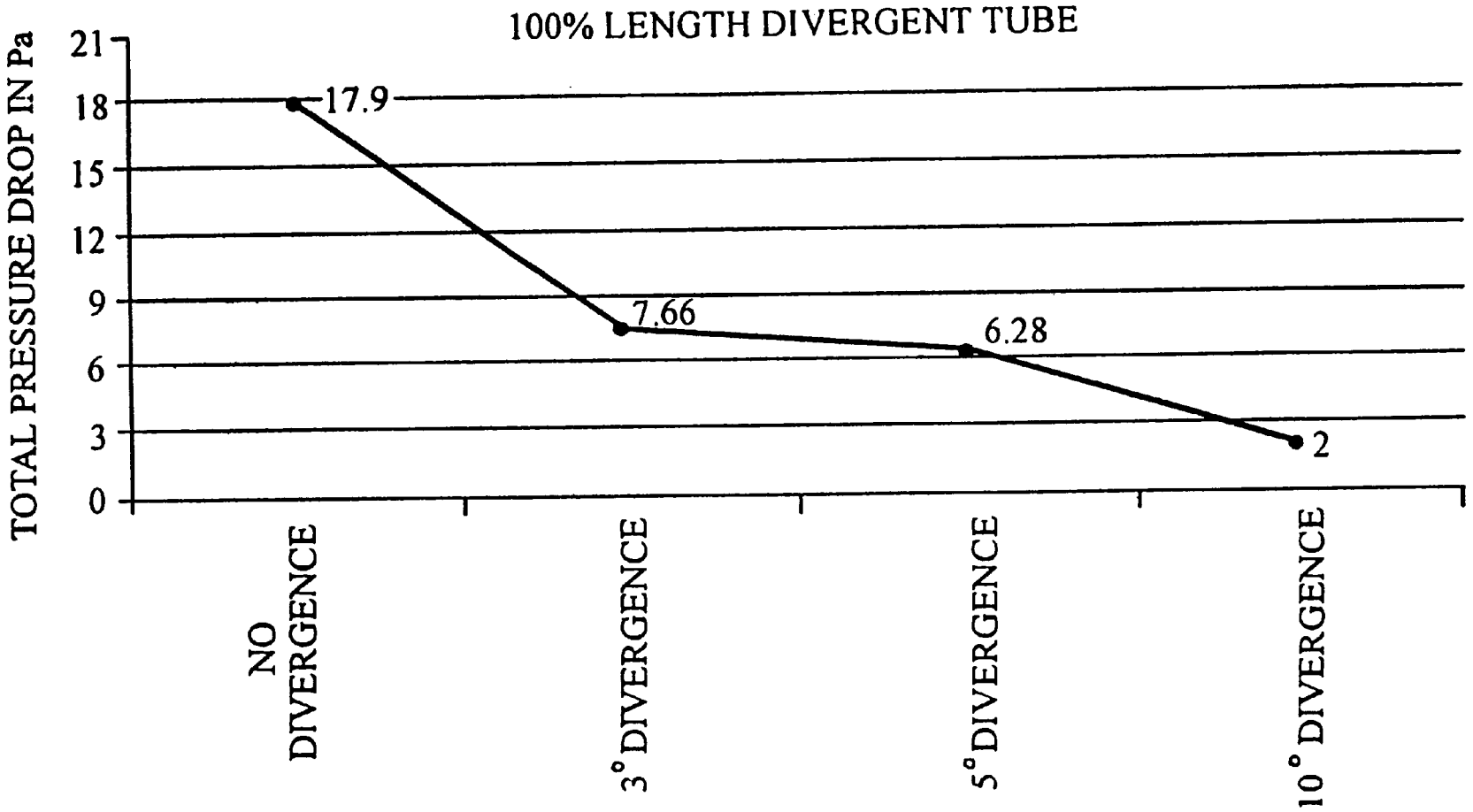
FIG. 19 is a graphical representation showing the variation in pressure drop in relation to the angle of divergence in relation to length when the tube diverges throughout its length.

FIG. 19 is a graphical representation showing the variation in pressure drop in relation to the angle of divergence for a tube which is divergent throughout its length.

Figure 20:
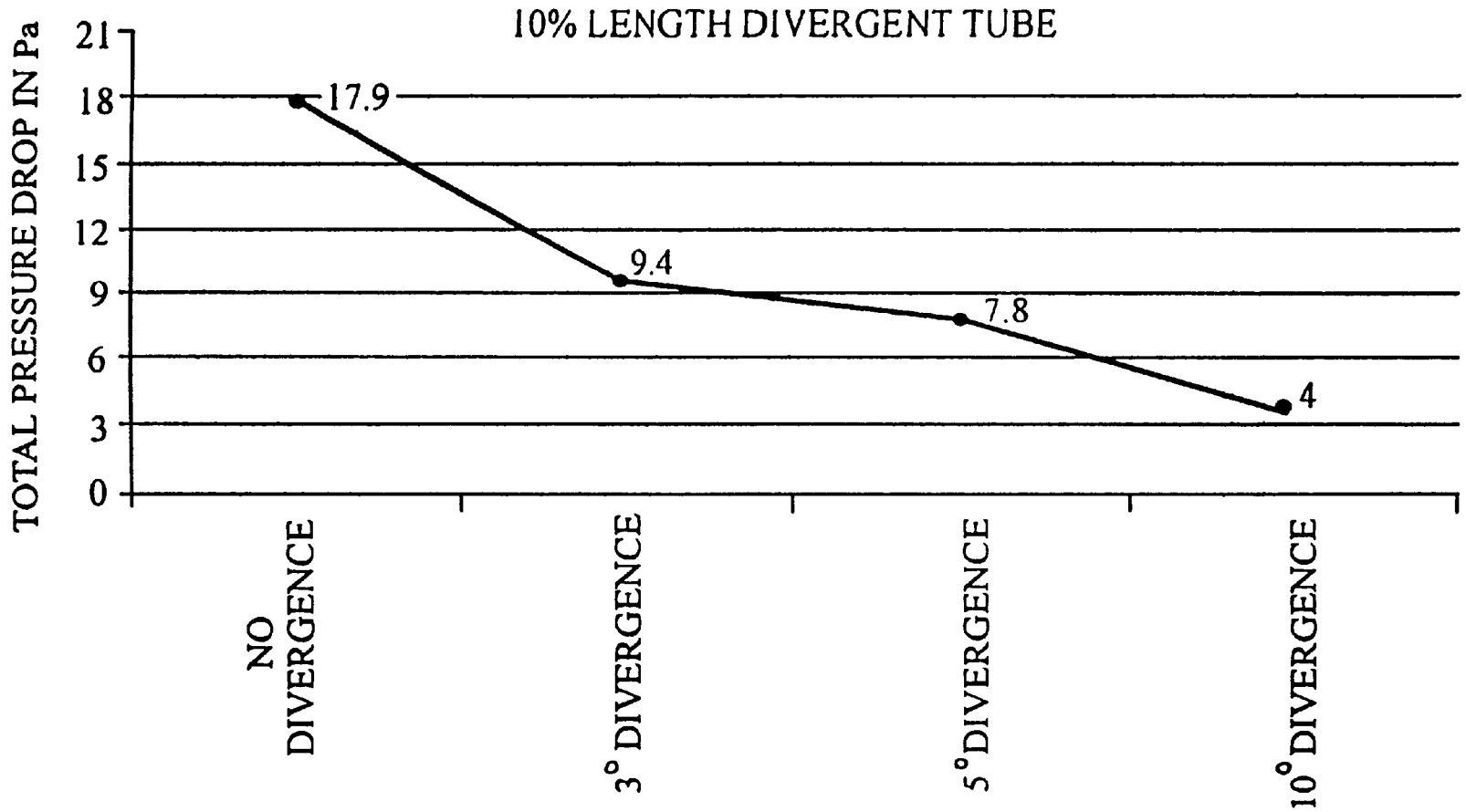
FIG. 20 is a graphical representation showing the variation in pressure drop in relation to the length of divergence of 10%.

FIG. 20 is a graphical representation showing the variation in pressure drop in relation the angle of divergence of a tube which is divergent to the extent of 10% of its length.

Figure 21:
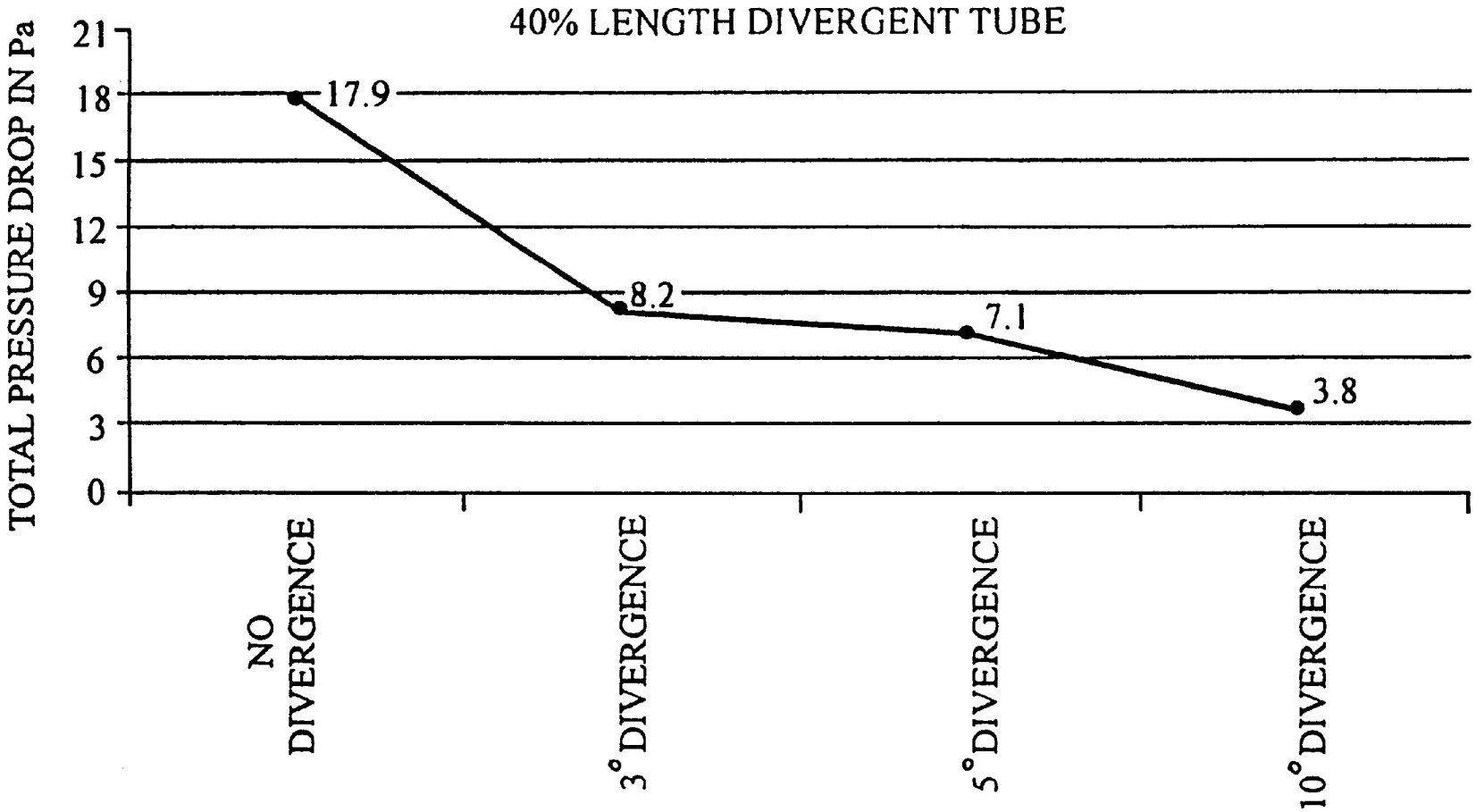
FIG. 21 is a graphical representation showing the variation in pressure drop in relation to the length of divergence of 40.

FIG. 21 is a graphical representation showing the variation in pressure drop in relation the angle of divergence of a tube which is divergent to the extent of 40% of its length.

Analysis of results:

1. The acoustic and flow results for four cases namely 24 perforations, 12 perforations, 4 perforations and no perforations are depicted. In the acoustic analysis, frequency is plotted against x axis and the transmission loss which is calculated as 20 log (P in/P out) where P indicates pressure. The analysis shows that the transmission loss and therefore attenuation at audible frequencies 50-2000 K Hz is high. 12 perforations appear to give optimum results. Therefore perforations in the muffler tube reduce the compressor noise generated as a result of refrigerant fluid flow and pulsation. As far as pressure drop is concerned, there is a general increase in pressure drop with the increase in the number of perforations.
2. The variation of perforated area to muffling tube area experiments involved using tubes with perforations of different diameters. With a median of 0.0625 inch diameter perforation in muffling tubes of a standard diameter of 0.36 inch with perforations 1.5 times this diameter and half this diameter were selected. Increase in perforated area tends to increase transmission loss up to the optimum of 0.0625 diameter perforations. There is no significant increase in transmission loss by increasing the perforation diameters beyond 0.0625 inch. However pressure drop increases considerably when the diameter of perforations and therefore perforated area is increased.
3. Experiments were conducted by varying the main tube diameter for the same number[12] and size [0.0625] of perforations. Taking 0.36 inch as the optimum median, two cases were studied with 25% reduction in diameter and with a 50% increase. The graphical analysis shows that reducing the main tube diameter shows increase transmission loss and therefore better attenuation of sound but the pressure drop increases substantially.
4. Experimenting with the shape of the perforations shows that variation in shape [circular/semicircular] has a marginal effect on both transmission loss and pressure drop.
5. Experiments with change in the angle of divergence of the muffler tube show that increase in the angle of divergence tends to generally lower the pressure drop. Even a 3 degrees angle of divergence causes a decrease in pressure drop of 50%. Generally an increase in length of divergence tends to decrease pressure drop with an optimum of 10 to 20 percent of the length of the tube commencing from the inlet.

ADVANTAGES

1. The suction muffler configuration will avoid the refrigerant fluid super heating to great extent as well as pressure drop in the muffler. This means more amount of refrigerant fluid will be supplied for the same duration of suction valve opening resulting more mass flow rate.
2. Pressure drop is significantly less in the muffler configuration in accordance with this invention as compared to other muffler configurations
3. Attenuation is good in frequency band of 0.5 to 3 KHz which is analyzed using SYSNOISE package.

While considerable emphasis has been placed herein on the structures and structural interrelationships between the component parts of the preferred embodiments, it will be appreciated that many embodiments can be made and that many changes can be made in the preferred embodiments without departing from the principals of the invention. These and other changes in the preferred embodiment as well as other embodiments of the invention will be apparent to those skilled in the art from the disclosure herein, whereby it is to be distinctly understood that the foregoing descriptive matter is to be interpreted merely as illustrative of the invention and not as a limitation.

We claim:

1. A suction muffler for a hermetic sealed reciprocating compressor comprising (i) a muffling chamber having a body of a synthetic polymeric material and (ii) a synthetic polymeric perforated tube passing through the muffling chamber carrying refrigerant fluid from a suction tube of a compressor to a suction port on a valve plate of a cylinder in which a piston reciprocates the perforated tube having a projection tongue near its outlet end for mounting the muffler in a complementary slot formed in a cylinder head such that a muffler outlet is in fluid tight communication with the suction port of the valve plate.

2. A suction muffler for a hermetic reciprocating compressor as claimed in claim 1, in which a diameter of the perforated tube varies from 0.1" to 1".

3. A suction muffler for a hermetic reciprocating compressor as claimed in claim 1, in which the number of perforations in the perforated tube vary from 4 to 120.

4. A suction muffler for a hermitically sealed compressor as claimed in claim 1, in which a diameter of the perforations of the perforated tube vary from 0.01 to 0.25.

5. A suction muffler for a hermetically sealed compressor as claimed in claim 1, in which a drain hole is provided at the bottom of the muffler chamber to drain lubricating oil present along with refrigerant fluid flowing through the muffler.

6. A suction muffler for a hermetically sealed compressor as claimed in claim 1, in which the perforated tube diverges at least 10 per cent along its length from its inlet to its outlet.

7. A suction muffler for a hermetically sealed compressor as claimed in claim 1, in which the perforated tube and the muffling chamber are integrally molded as two separate halves joined together by bonding or ultrasonic welding.

8. A method of mounting a muffler directly in a cylinder head of a hermetically sealed compressor comprising the steps of:

{i} forming a projection tongue on a muffler tube;

{ii} forming a slot a cylinder head complementary to the projection formed on the muffler tube; and {iii} mounting the muffler in the cylinder head by press fitting the projection on the muffler tube into the slot in the cylinder head.

9. A hermetically sealed compressor which comprises a motor compressor assembly mounted in a shell which includes a cylinder head and a muffler in which the muffler is fitted to the cylinder head by means of a male projection formed on a muffler tube and a complementary slot formation provided in the cylinder head and clamped over by the pressure of a valve plate bearing upon it.

* * * * *